US010570537B2

(12) United States Patent
Uboldi

(10) Patent No.: US 10,570,537 B2
(45) Date of Patent: Feb. 25, 2020

(54) FABRIC MANUFACTURING METHOD

(71) Applicant: TESSITURA CLARA S.r.L., Veniano (IT)

(72) Inventor: Andrea Uboldi, Guanzate (IT)

(73) Assignee: TESSITURA CLARA S.r.L., Veniano (Como) (IT)

( * ) Notice: Subject to any disclaimer, the term of this patent is extended or adjusted under 35 U.S.C. 154(b) by 107 days.

(21) Appl. No.: 15/691,114

(22) Filed: Aug. 30, 2017

(65) Prior Publication Data

US 2018/0057976 A1 Mar. 1, 2018

(30) Foreign Application Priority Data

Aug. 30, 2016 (IT) ..... 102016000088166

(51) Int. Cl.

| | |
|---|---|
| ***D03D 3/02*** | (2006.01) |
| ***D03D 15/00*** | (2006.01) |
| ***D02H 7/00*** | (2006.01) |
| ***D02H 5/00*** | (2006.01) |
| ***D02H 11/00*** | (2006.01) |

(Continued)

(52) U.S. Cl.

CPC ..... *D03D 3/02* (2013.01); *D02G 3/12* (2013.01); *D02H 5/00* (2013.01); *D02H 7/00* (2013.01); *D02H 11/00* (2013.01); *D03D 15/0027* (2013.01); *D03D 15/08* (2013.01); *D10B 2101/20* (2013.01); *D10B 2201/02* (2013.01); *D10B 2331/02* (2013.01)

(58) Field of Classification Search

CPC ..... D02G 3/12; D03D 3/02; D03D 15/08; D03D 15/12; D03D 15/0027; D03D 11/00; D03D 15/00; D03D 21/00; D02H 5/00; D02H 7/00; D02H 11/00; D02H 3/00; D10B 2331/02; D10B 2201/02; D10B 2101/20

See application file for complete search history.

(56) References Cited

U.S. PATENT DOCUMENTS 3,838,983 A * 10/1974 Brown ..... D03D 15/00 139/391
4,668,545 A * 5/1987 Lowe ..... B29C 61/0658 139/387 R (Continued)

FOREIGN PATENT DOCUMENTS

CN 201265071 Y 7/2009
CN 102373534 A 3/2012

(Continued)

*Primary Examiner* — Amy Vanatta
(74) *Attorney, Agent, or Firm* — Vorys, Sater, Seymour and Pease LLP

(57) ABSTRACT

A method for making tubular fabrics is provided. The method includes using metallized yarns including at least one ribbon which is less than 0.7 mm thick, the ribbon being preferably spiral-wound with at least one support thread. The method also includes using non-metallized main yarns, as well as making a warp beam including the metallized yarns and said main yarns, the warp beam having a linear thread density preferably higher than 40 threads/cm. The method may also include a step of weaving in which a tubular fabric is made by means of the beam warp with the metallic yarns arranged exclusively on the warp.

13 Claims, 7 Drawing Sheets

(51) Int. Cl.
*D02G 3/12* (2006.01)
*D03D 15/08* (2006.01)

(56) References Cited

U.S. PATENT DOCUMENTS

| | | | | |
|---|---|---|---|---|
| 5,415,204 | A * | 5/1995 | Kitamura | D03D 3/02 139/384 R |
| 2008/0057812 | A1* | 3/2008 | Kataoka | D01F 1/10 442/182 |
| 2015/0038034 | A1* | 2/2015 | Lukas | D02G 3/12 442/60 |
| 2017/0065013 | A1* | 3/2017 | Choudhry | D06M 13/00 |

FOREIGN PATENT DOCUMENTS

| | | | |
|---|---|---|---|
| CN | 204898223 | U | 12/2015 |
| KR | 10-1446003 | B1 | 9/2014 |

* cited by examiner

FABRIC MANUFACTURING METHOD

FIELD OF THE INVENTION

The present invention relates to a manufacturing method for fabrics, preferably denim, in particular by means of industrial methods which can be applied to the weaving looms preferably of Jaquard type.

DESCRIPTION OF THE PRIOR ART

Fabrics, e.g. denim, are currently known, which are also known as Jeans fabrics. Some examples of methods for manufacturing fabrics are described in patents KR-B-101446003, CN-U-204898223 CN-A-204898223 CN-A-201265071, CN-A-102373534.

Denim fabrics are usually made of a cotton warp and a linen or cotton only weft. In the most common denim fabrics, the warp threads are dyed blue, generally denim indigo blue, and the weft threads remain in the natural raw color of the linen or cotton, generally white.

Furthermore, in such fabrics, the weft threads pass under two or more warp threads at a time.

As known, denim fabrics and their variants have always enjoyed great commercial success, in particular for garments such as pants and the like, by virtue of their physical strength and their pleasant appearance.

Many variants of denim fabrics obtained with various yarns, even elasticized or of different colors are made today.

They are also generally washed out, after making the garment, to obtain aging and worn look effects. Such operations are achieved with chemical and/or mechanical additives which heavily stress the structure of the fabric.

Another highly appreciated aesthetic effect in fabrics in general is the use of yarns with metallized surface effect: in particular, these are yarns known with the brand names of Lurex®, Lame®, Ledal® and other.

The prior art described above has major drawbacks.

Indeed, metallized threads are difficult to apply to denim type fabrics and the like. Furthermore, such metallized threads, when applied to denim type fabrics and the like, create unpleasant surface effects and may be externally raised from the surface of the fabric whereby creating an unpleasant feel and appearance. In particular, such surface effects are increased by the washing out treatments and the like to imitate said worn effects.

Furthermore, making elasticized denim type fabrics including said metallized yarns is very complex.

In order to partially avoid said drawbacks, some fabric manufacturers use very complex textile machines including a plurality of beams which may tension different yarns with different tensions. However, such machines are very costly and generally not present in weaving mills. Furthermore, the textile machines themselves do not completely solve the described drawbacks.

In this situation, the technical task underlying the present invention is to devise a method for manufacturing fabrics capable of solving the described drawbacks, at least in part.

In the scope of said technical task, it is an important object of the invention to create a method for manufacturing fabrics which makes it possible to obtain fabrics including metallized threads which remain substantially comprised in the surface of the fabric, preferably also following washing out treatments and the like.

It is a further technical task underlining the present invention to obtain a method for manufacturing fabrics, e.g. denim, which make fabrics which are elasticized.

SUMMARY OF THE INVENTION

The technical task and the specified objects are achieved by a method for making fabric on tubular base, comprising: using metallized yarns comprising, at least one ribbon which is less than 0.7 mm thick, the ribbon being preferably spiral-wound with at least one supporting thread, using non-metallized main yarns, making at least one beam warp comprising the metallized yarns and the main yarns, the beam warp having a linear thread density preferably greater than 40 threads/cm, a step of weaving, wherein a tubular fabric is made by means of the beam warp with the metallized yarns arranged exclusively on the warp.

BRIEF DESCRIPTION OF THE DRAWINGS

The features and advantages of the invention will be explained in the following detailed description of preferred embodiments of the invention, with reference to the accompanying drawings in which.

DESCRIPTION OF THE PREFERRED EMBODIMENTS

Figure 1:
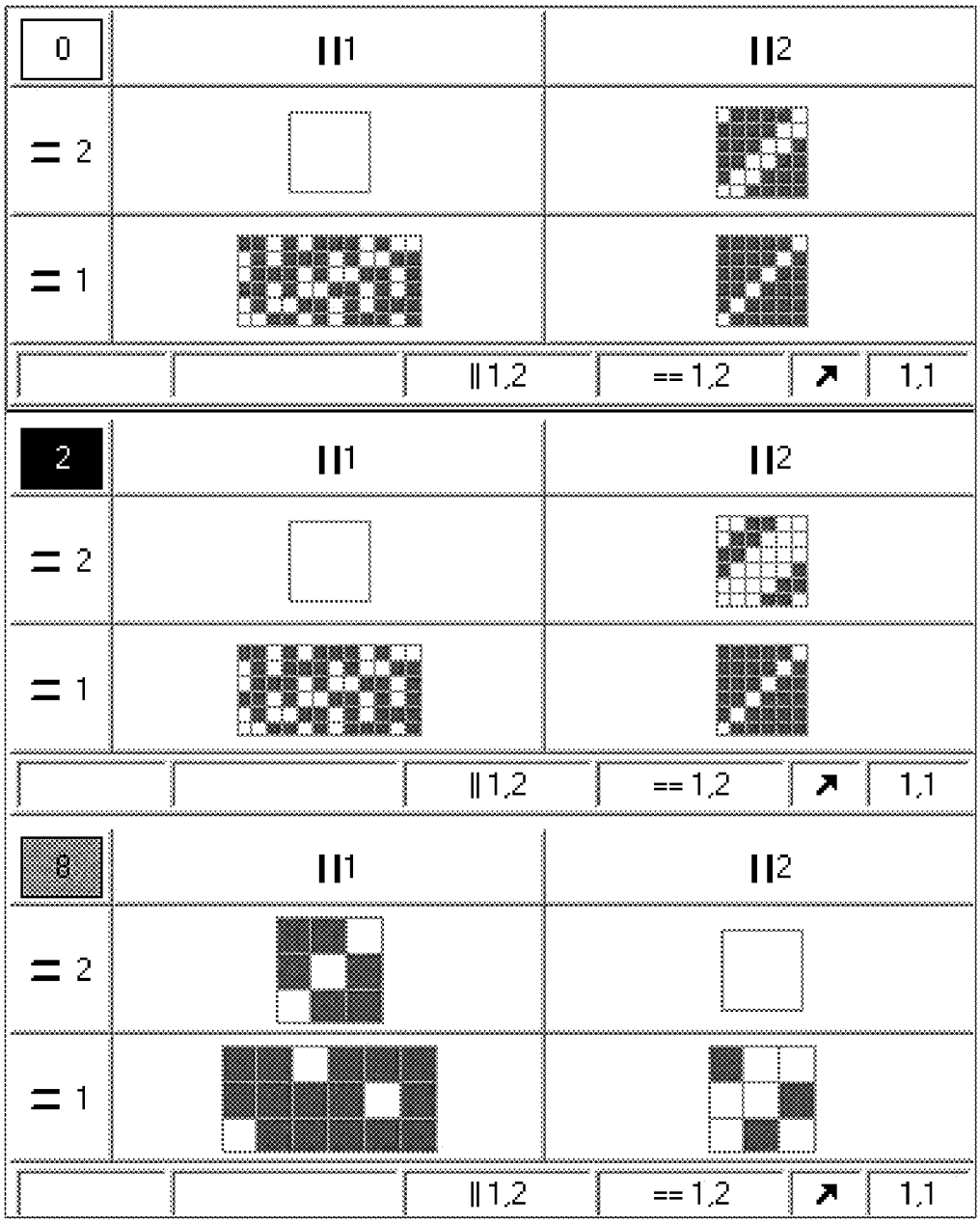
FIG. 1 shows a first example of settings for making a part of the method according to the invention.

In the present invention, measurements, values, shapes and geometric references (such as perpendicularity and parallelism), when associated to words such as "about" or similar words, such as "almost" or "substantially", are to be understood as short of errors of measurement or inaccuracies due to production and/or manufacturing errors, and above all, short of a minor divergence from the value, measurement, shape or geometric reference to which it is associated. For example, such words, if associated to a value, preferably indicate a divergence not higher than 10% of the value itself.

Furthermore, when used, words such as "first", "second", "upper", "lower", "main" and "secondary" do not necessarily identify an order, a relationship priority or a relative position but may be simply used to distinguish different components more clearly.

Unless otherwise indicated, the measurements and data shown in the text must be understood as performed in International Standard Atmosphere ISA (ISO 2533).

The method for making denim fabrics according to the invention comprises using a metallized yarn and preferably also a step of manufacturing said metallized yarn. Said metallized yarn comprises at least one thin ribbon, i.e. a strip, with surface metallized by means of galvanic or other treatments, having a maximum width preferably smaller than 0.7 mm, more preferably comprised between 0.7 mm and 0.15 mm (width means the maximum dimension of the normal section of the ribbon). Said ribbon is spiral-wound preferably with at least one support thread, and more preferably two support threads. Said support thread appropriately consists of a polymeric yarn, preferably smooth or textured, preferably made of polyamide 6 or 6.6, known with the trademark of Nylon®. Said support thread is preferably of the multifilament or microfilament type, wherein the count of each single filament is preferably lower than 1.6 Dtex, and more preferably comprised between 1.6 Dtex and 0.5 Dtex, and the count of the support thread itself is preferably lower than 35 Dtex, and more preferably comprised between 22 and 8 Dtex.

The two support threads are spiral-wound about said ribbon, one in direction "S" and the other in direction "Z" with preferably the same twists, in order to create a torsion-free final yarn which consequently tend not to turn, wherein the twists to be applied are preferably higher than 800 and more preferably comprised between 800 and 1600 twists per meter.

Furthermore, main yarns which are non-metallized and preferably made of cotton or other fibers, preferably dyed, more preferably dyed in indigo blue, with possible additions of black to vary the color brightness, are either used or appropriately made. The main yarn may be also dyed with other techniques, such as for example with so-called sulfur dyes, which in all cases make it possible to make non-solid colors which wash out in the washing processes in the fabric or on the garment. Alternatively, solid dyes may be used, in particular of the direct, reactive or Indantrene® type, for cotton or viscose, or for silk, polyester, acetate, nylon, wool and other yarns by means of specific dyes known to a person skilled in the art. Appropriately, the count of said main yarns is preferably comprised between 20 dtex and 590 dtex.

In particular, if they are made of cotton, said main yarns may preferably have one or two plies and appropriately a count preferably comprised between 20/2 NE (i.e. 590 dtex) up to 120/2 NE (i.e. 98 dtex) in the case of two ply yarns or of 10/1 NE (i.e. 590 dtex) up to 60/1 NE (i.e. 98 dtex) in the case of single ply yarns.

In the case of other yarns, such as silk, viscose, acetate, the minimum counts may be much smaller and even the maximum counts may be lower, e.g. comprised between 20 and 200 dtex.

This yarn is then appropriately collected after dyeing preferably indigo, on hard cones and/or on support beams.

One of the main yarns may be made of elasticized, non-metallized yarn preferably made of elasticized polyamide or other elasticized material.

The method according to the invention comprises a step of manufacturing of a beam warp consisting of at least one metallized yarn and of at least one main yarn. One metallized yarn and three main yarns are preferably used.

Further yarns may be added, also more than one, preferably made of cotton or also other fibers, and if the other main yarns are of the dyed indigo type, they made also of the raw, bleached or dyed in another color instead of the dyed indigo type.

In the present text, when single weft and warp yarns in the final weave are described, it is understood that such single threads are periodically repeated along the entire sequence of the weft threads and along the entire sequence of the warp threads of the entire fabric, respectively, in periodical manner or in all cases in the respective warp sequences and weft sequences.

The beam thus made is connected to a reed, which has a linear thread density preferably appropriately higher than 40 threads/cm and more preferably comprised between 45 threads/cm and up to about 100 threads/cm. The height of the reed from the fabric on the loom which will be preferably from 175 cm to 240 cm in total for single looms or double for double width looms, which can thus weave two fabrics at the same time. The number of threads of the warp beam will also be preferably higher than 8000, more preferably comprised between 8000 and 24000, in particular in the case of single looms or double values in the case of double looms. In such step, the metallized yarn is conveniently placed on the warp and not on the weft, because the warp threads of a fabric, e.g. standard elasticized denim (not bi-stretch) are not subject to high shrinkage (about from 2% to 5%), whilst instead the elasticized weft of the fabric is subject to a high shrinkage (from a minimum of 15% up to even 50%).

The aforesaid beam warp is appropriately warped on standard warping mills of sectional type, in particular in the case of two ply yarns. Instead, the single ply yarns are preferably glued before warping onto the final beam, while the metallized yarn is preferably not glued.

Warping mills of known type are preferably used in order to make said beam warp. The used warp sequences preferably comprise a portion periodically repeated on the fabric width, three or four main yarns and one metallized yarn.

In a successive step of knotting, the described beam warp is knotted to standard looms, e.g. of Jacquard type, in manner known in itself.

During the step of weaving, the metallized yarn and the support yarns are appropriately tensioned by tensioning one or more of the pinch rolls of the yarns themselves. Specifically, the rolls pinch the fabric in front of the loom after it is formed and, obviously, it is connected to all the warp threads and consequently pinches and tensions the warp threads. The tension is given by means of the speed difference between the unwinding of the warp beam and the pinching of the fabric in front of the loom.

Tensions are applied to such pinch rolls which reciprocally vary by a measure lower than 5%, wherein applied tensions among the pinch rolls varies less than +/−5%, preferably the same unwinding tension is applied to the rolls themselves. In particular, the metallized and support yarns, in particular cotton, may be arranged on the same beam and on the same rolls, so that they all have the same unwinding tension.

Said unwinding tension is preferably comprised between a tension from 75 to 450 kgp on the entire set-up, i.e. from about 5 g to 40 g (grams-force) per thread if uniformly calculated on all the threads.

The advantageous possibility of using a single beam is conferred in particular by the peculiar metallized yarn and the selected tensions.

The successive step of weaving is achieved with weaving cards by means of which fabrics with metallized effects, preferably elasticized in weft way, and preferably denim or other type, are appropriately obtained. Furthermore, one or more of the following rules are preferably performed:

The fabrics are woven on a tubular base, preferably on two layers but also on more than two layers.

in particular for denim type fabrics, the right side, or upper layer, in the indigo color background zones has an appropriately heavy weave, i.e. with the chain prevalently on top on the right side and the weft on the bottom on the wrong side, and uses the main yarns, preferably dyed indigo, where the threads of the chain are exposed and the weft is hidden instead. Diagonal weaves of different types are preferably used so as to enhance the typical diagonal of denim. Conveniently, heavy 3×1 twills, heavy 6×1 twills, heavy 4×2 twills and others may be used according to needs and according to how much the diagonal is desired to be enhanced.

The right side in the pattern zones is preferably obtained by replacing the main yarns in the weaves with metallized yarns and by using specific weaves which enhance, i.e. keep more raised or possibly conceal, the metallized yarn with respect to the other main yarns so as to create pleasant, more or less intense light effects on the fabric.

The wrong side, or lower layer, of the fabric instead uses a weave of the double chain face sateen type with wrong side using the main warp yarn while the metallized yarn is used for the right side.

The tubular right side and the wrong side of the fabric which is the object of the invention preferably are not left tubular (and thus separate) but are joined by means of appropriate binding stitches which will tend to follow and possibly conveniently enhance the preferably diagonal effect by intensifying it but also of other right side type without creating faults, lack of uniformity or unpleasant stitches which are visible on the right side.

Preferably, the wrong side yarn will be coarser or even much coarser than the metallized yarn and this will make the metallized yarn disappear even more in the inside of the non-metallized threads once the fabric is finished with its correct elastic shrinkage and, in particular in the case of denim fabrics, after the garment is washed. In this manner, the metallized yarn avoids creating annoyance on the skin by being less comfortable to the feel and on the skin than cotton or other non-metallized fibers used in the main yarns.

Different types of effects may be produced using different weaves for the different zones of the fabric: zones on the right side with or without metallized effect, zones on the wrong side, zones with or without stitches between right side and wrong side. For example, the figures illustrate examples of weaves which can be easily read and understood by a person skilled in the art.

In particular, FIG. 1 shows a fabric with metallized thread effect with thin diagonal weave different from the background and with well bound wrong side. The four boxes identify the four possible combinations of odd (1) and even (2) weft threads and odd (1) and even (2) chain threads and the weaves which are applied to these combinations, respectively. Conveniently, a warp sequence of A, B, C, B type is present, wherein A is for example a raw cotton yarn, B is an indigo color dyed cotton yarn and C is a metallized yarn, and a weft sequence of (a b) type is present, wherein a is an elasticized nylon yarn of color 1 and b is an elasticized nylon yarn of color 2. Weaves of this type are used in the case of small-size metallized effects and in all cases where it is required for the fabric to display differences of tension and compactness in the different zones of its pattern. The fabric thus appears to sink into the background of the pattern without metallized effect (color 0 and color 2 enhanced) at the pattern with metallized effect (color 8 in figure).

Figure 2:
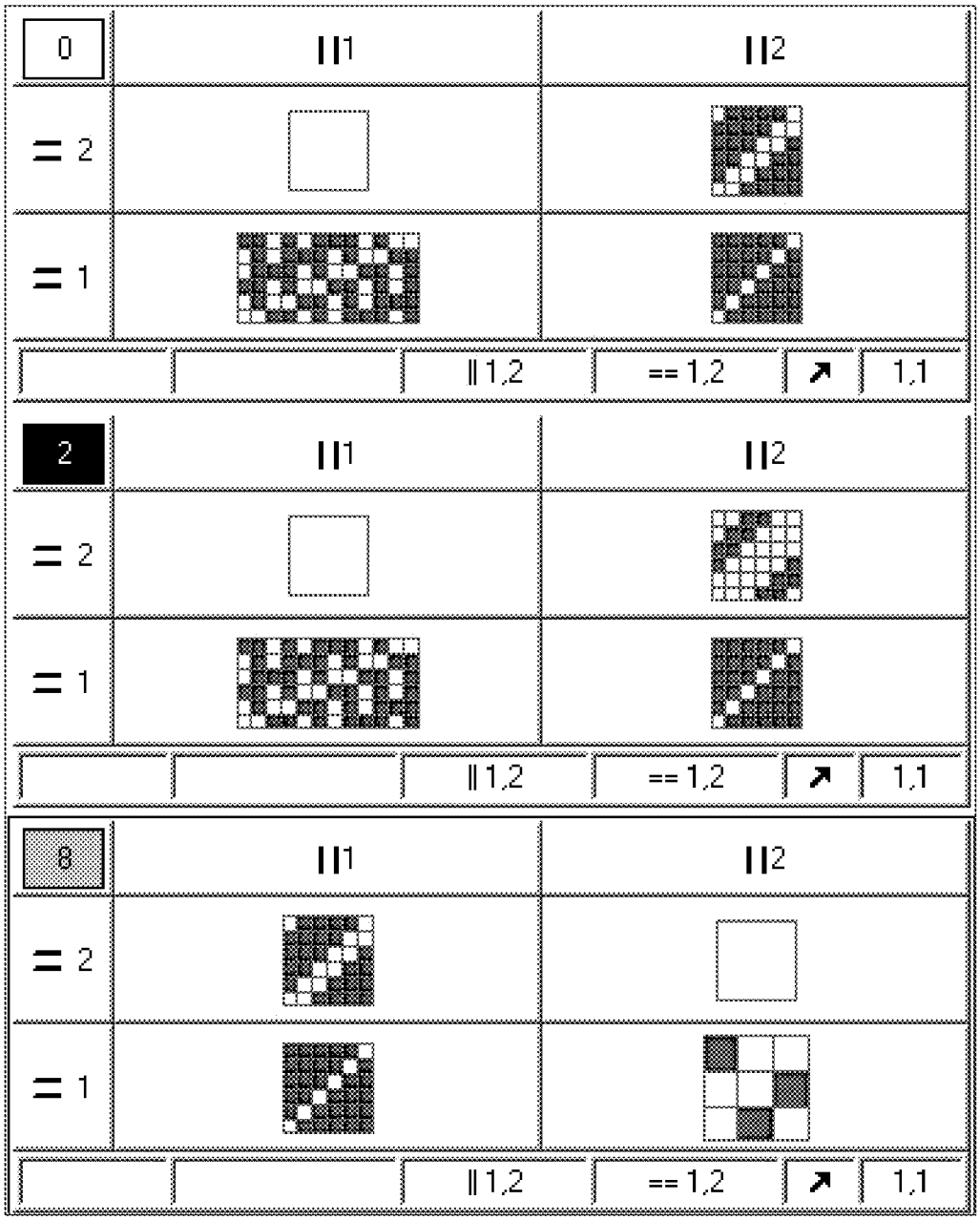
FIG. 2 shows a second example of settings for making a part of the method according to the invention.

FIG. 2 shows a fabric with metallized thread effect with diagonal weave as background and more bound wrong side. This is useful in the case of medium-size metallized effects and where it is required for the fabric to display minor difference of tension and compactness in the different zones of its pattern. The back of color zone 8 corresponding to the part of the pattern with metallized effect has a normal light 3×1 twill wrong side because the metallized threads are on the right side in this zone and therefore cannot create annoyance on the wrong side, and it is consequently not necessary to use a double chain face weave, fact which is instead very useful in the case of color 0 and of color 2 which belong to the background without metallized effect on the right side and thus the metallized threads will be on the wrong side in the respective zones.

Figure 3:
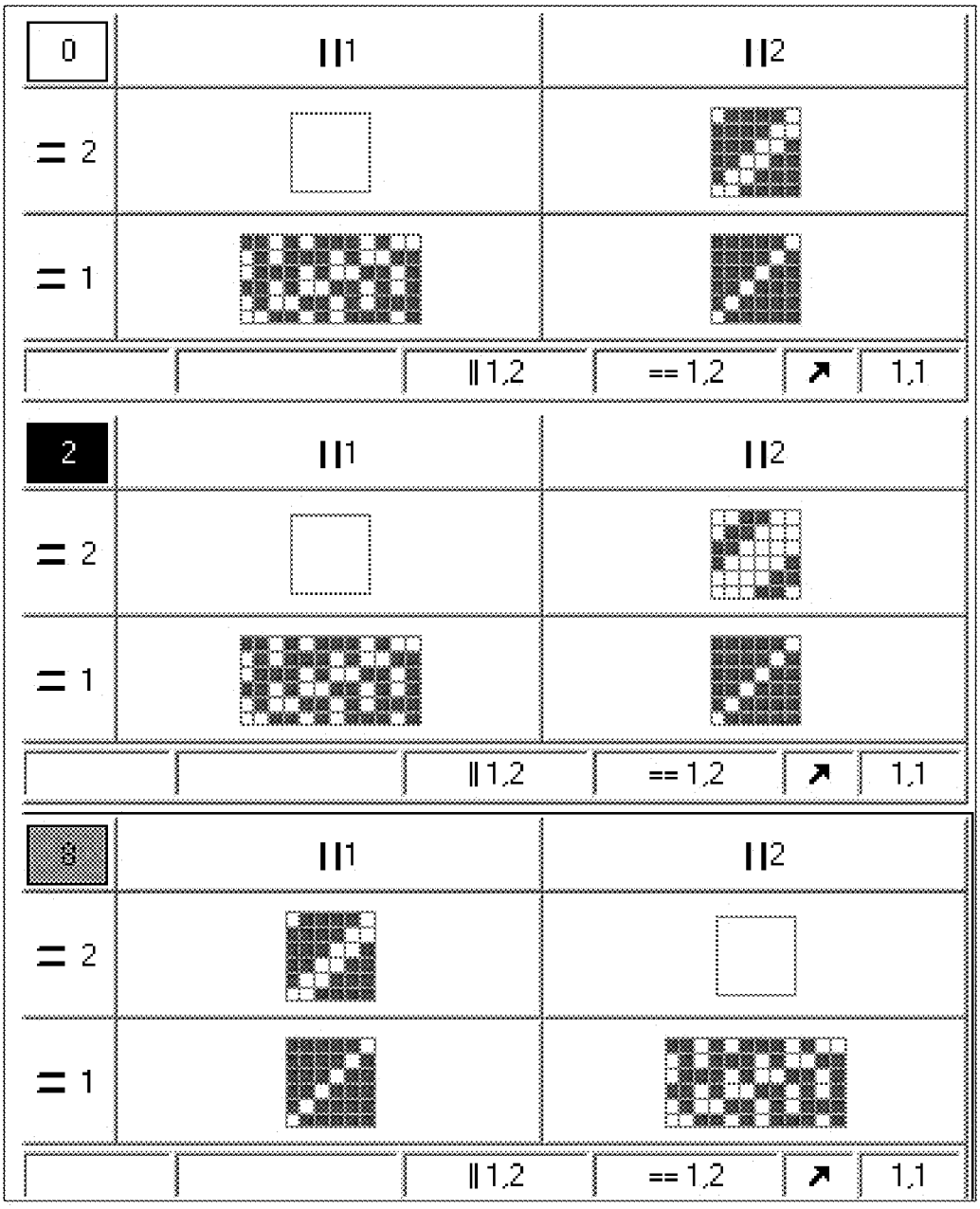
FIG. 3 is a third example of settings for making a part of the method according to the invention.
Figure 4A:
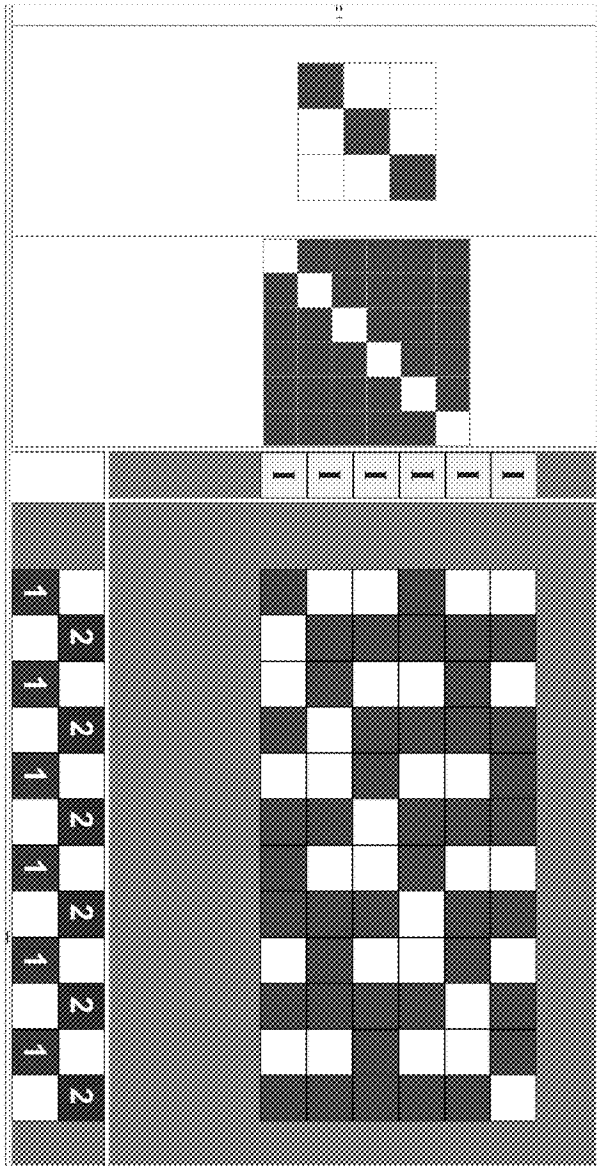
FIG. 4*a* shows an example of settings for making a part of the method according to the invention.

FIG. 3 shows a fabric with metallized thread effect with diagonal weave as background and less bound wrong side. This is useful in the case of large size metallized effects and where it is required for the fabric to display differences of tension and compactness in the different zones of its pattern. Also in this case, the first two boxes with color 0 and color 2 (each illustrating the four bindings) represent two zones without metallized effect on the right side of the pattern and it is apparent how they are bound to the tubular layer on the wrong side by a diagonal represented by a heavy 6×1 twill which binds the wrong side weft to the right side and which consolidates the diagonal effect already present on the right side (weft 1 and warp 2 box). The third quadrant with color number 8 is the zone of the pattern with metallized effect. Weaves which produce different effects on the fabric can be made. FIG. 4*a* shows an example of weaves for the wrong side. The warp yarn 1 represented in the box by Arabic numeral "1" is the non-metallized yarn, while the warp yarn 2 represented in the box by Arabic numeral "2" is the metallized yarn. The weft 1 is represented in the box by Roman numeral "I". It is apparent that the non-metallized yarn 1 conveniently creates a light 3×1 twill and thus remains prevalently on the wrong side, whilst the metallized yarn 2 creates a heavy 6×1 twill, and thus remains prevalently on the right side. Since this only is the wrong side layer of the fabric which is the object of the present invention and since the final fabric has another right side layer which is in all cases bound to the wrong side, according to the present invention the metallized threads will remain conveniently confined in the contact gap between the two fabrics of the right side and of the wrong side, well bound to each other in all cases, also in the case of patterns with large zones, and thus well concealed so as to be neither seen nor touched either on the right side or on the wrong side and, in particular in the case of denim fabrics, so as to well support the stresses to which the denim fabric is subjected during the successive steps of washing and finishing of the material in the piece and as the garment.

Figure 5:
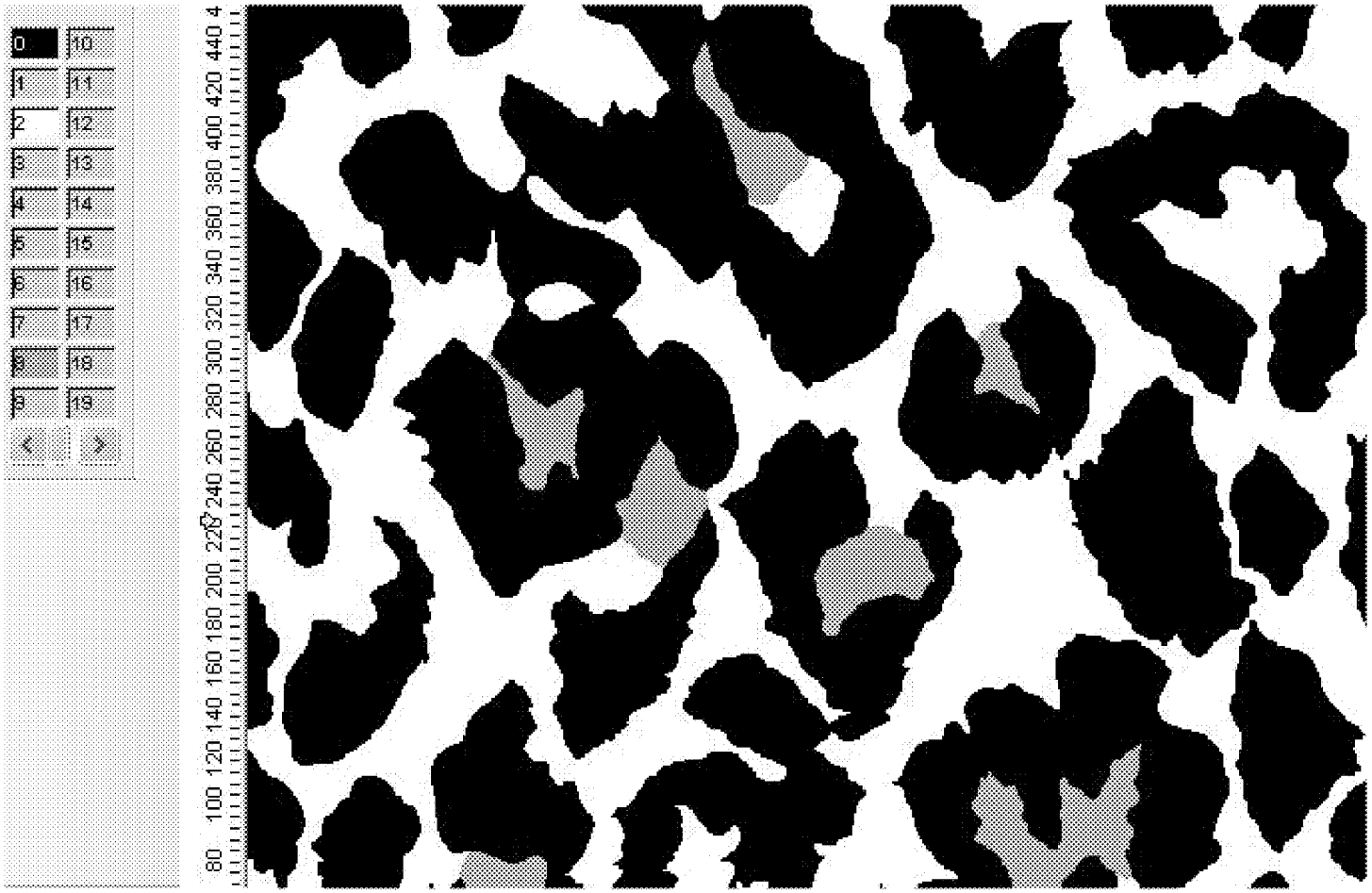
FIG. 5 is an example of fabric made according to the method according to the invention.

FIG. 5 shows an example of pattern of the leopard print type which may be made with the weaves described above. It is worth noting the references of color 0 and of color 2 of the background without metallized effect and of color 8 which instead displays the metallized effect.

Figure 6:
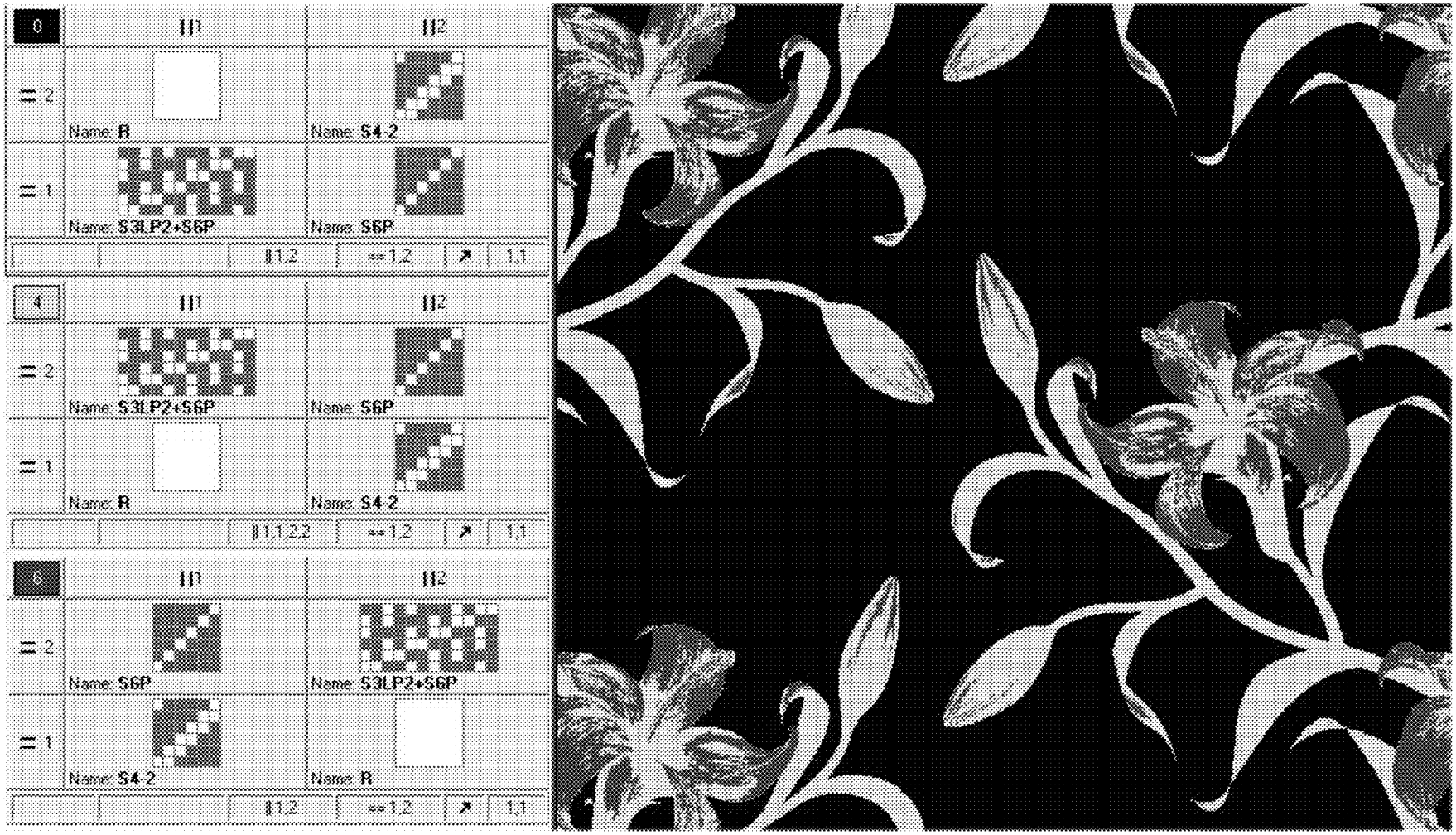
FIGS. 6 and 7 are further examples of fabric made with the method according to the invention.

FIG. 6 shows another embodiment of the present invention in which the zones with metallized effect in the pattern are 2 instead. As mentioned, color zone 6 uses the main thread dyed in a different color than that of the background, i.e. in the case of denim of color not dyed indigo together with the metallized yarn to obtain a particularly light and brilliant effect which is not washed out because it is not dyed indigo. The zone of color 4 instead shows how the threads are used with a different warp sequence. Indeed, the header underneath the four boxes of the armatures (II 1,1,2,2) shows that the so-called warp threads 2 are no longer the even threads, but are instead the thread with position 3 with position 4 in a group of 4. In other words, referring to the warp sequence A B C B, threads C and B which are the metallized thread, and the background color thread, i.e. in the case of denim fabrics of indigo color, are used respectively. So, in the case of denim fabrics, this metallized effect mixed with the indigo thread may then be subjected to a very pleasant and appreciated "washed out" effect.

Figure 7:
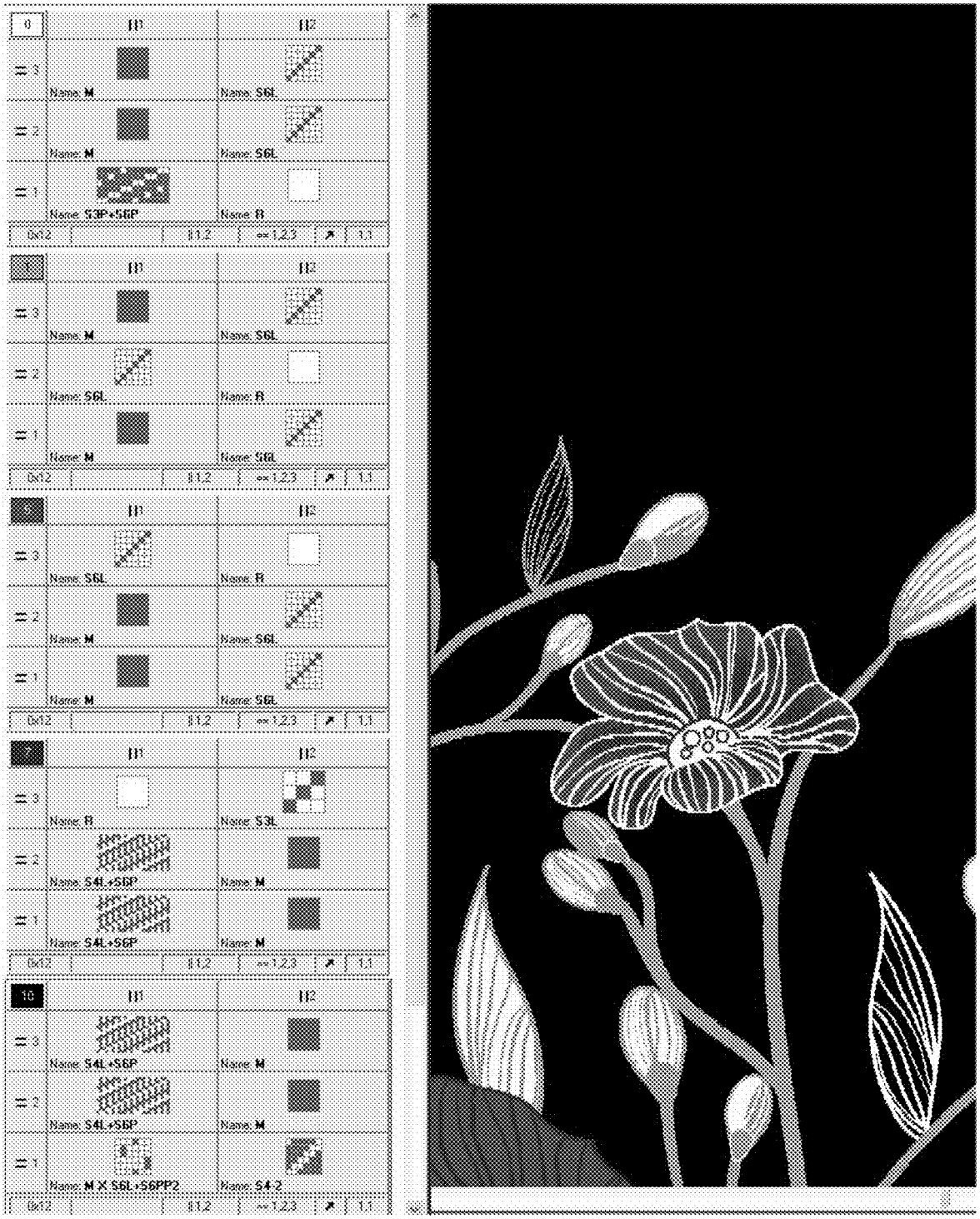

FIG. 7 shows an example of embodiment of a tubular fabric with more than 2 weft colors, i.e. with 3 colors. The two colors which are not used on the right side are appropriately bound on the wrong side maintaining a double chain face weave if it is bound with metallized yarns. In the case of 3 colors to be seen on the right side, the pickings per cm are increased in the fabric by about 50% with respect to 2 colors and a fabric structure which is compact but which still maintains the elasticity and appearance similar to the case of two colors on the right side is thus necessary. This type of structure makes it possible to obtain fabrics with many colors but at the same time well, but not excessively, compacted and above all not puffy, of very high value and beauty.

Figure 4B:
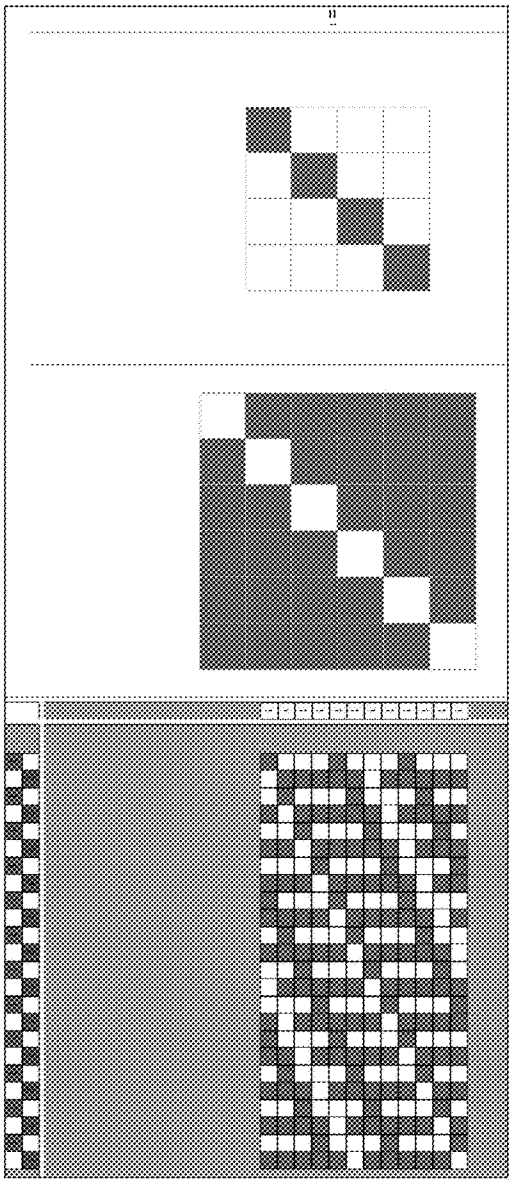
FIG. 4*b* shows a further example of settings for making a part of the method according to the invention.

FIG. 4*b* shows the particular of the weave used on the wrong side of the fabric described in FIG. 7. This is a light 4×1 twill on the wrong side and a heavy 6×1 twill on the right side bound in double chain face. By increasing the number of pickings per cm in the three-color fabrics with respect to the two colors, the wrong side weave which gathers the double of the threads per cm with respect to the case of two colors, which must be conveniently unbound. With this technique, we can unbind the weave on the wrong side and increase the pickings in it, keeping the fabric and its appreciated effects on the right side practically identical.

Preferably, the step of weaving is followed by a step of surface processing in which treatments known in themselves are applied, e.g. in particular in the case of denim fabrics, chemical and/or mechanical washing out or other processes which apply processing effects contributing a worn surface effect to the fabric.

The invention also comprises an innovative fabric, preferably of denim type, made with the described method or with the described yarns.

The invention further comprises a garment made with the described fabric. The method according to the invention achieves important advantages.

Indeed, the described method makes it possible to make fabrics, e.g. denim, e.g. elasticized, including metallized yarns which remain substantially comprised in the surface of the fabric, also following washing out treatments and the like.

Said advantages make it possible to contain a fabric, e.g. denim, e.g. elasticized, with metallized effects which remains comfortable and aesthetically pleasing.

Said fabric can be obtained also by means of standard type machines, preferably with a single warp beam. Such machines are more common and more cost effective than the machines including a plurality of warp beams.

The invention is susceptible of variants included in the scope of the inventive concept defined by the claims.

In such a scope, all the details may be replaced by equivalent elements and the materials may be of any shape and size.

The invention claimed is:

1. A method for making fabric on a tubular base, comprising:

providing metallized yarns comprising at least one ribbon having a thickness of less than 0.7 mm, said ribbon being wound with at least one supporting thread;

providing non-metallized main yarns;

making at least one beam warp comprising said metallized yarns and said non-metallized main yarns, and weaving a tubular fabric made by means of said beam warp with said metallized yarns arranged exclusively on the warp.

2. The method according to claim 1, wherein said tubular fabric has two layers: an upper layer, consisting of a single-layer simple weave, and a lower layer consisting of a reversible chain weave.

3. The method according to claim 2, wherein said upper layer is bound to said lower layer by means of at least one stitch.

4. The method according to claim 3, wherein in said step of weaving, said metallized yarns and said non-metallized main yarns are pinched by pinch rolls to which is applied an unwinding tension which varies from one said pinch roll to another said pinch rolls by less than 5%.

5. The method according to claim 4, wherein said unwinding tension is comprised between 5 and 40 grams-force per thread.

6. The method according to claim 1, wherein said supporting thread is made of polyamide.

7. The method according to claim 1, wherein there are two said supporting threads for each of said ribbons.

8. The method according to claim 1, wherein said beam warp is made with a periodical base consisting of one of said metallized yarns and from two to six of said main yarns.

9. The method according to claim 1, wherein said main yarns are made of material chosen from: cotton, polyester, acetate, silk, Viscose, Lyocell, Cupro, nylon and wool or mixtures thereof.

10. The method according to claim 1, wherein said metallized yarns and said main yarns are placed on the same beam.

11. The method according to claim 1, wherein a denim fabric is made in said step of weaving.

12. The method according to claim 1, comprising a step of surface processing of the fabric, adapted to apply processing effects which produce a surface wear and washed-out effect to the fabric.

13. The method according to claim 1, wherein said beam warp has a linear thread density greater than 40 threads/cm.

* * * * *